US006711746B1

(12) United States Patent
Orellana

(10) Patent No.: US 6,711,746 B1
(45) Date of Patent: Mar. 30, 2004

(54) GLOVE APPARATUS

(76) Inventor: Tyrone Orellana, 13807 Field Stone, Houston, TX (US) 77041

( * ) Notice: Subject to any disclaimer, the term of this patent is extended or adjusted under 35 U.S.C. 154(b) by 31 days.

(21) Appl. No.: 10/402,567

(22) Filed: Mar. 28, 2003

(51) Int. Cl.[7] ..... A41D 19/00
(52) U.S. Cl. ..... 2/160; 2/161.6; 362/34; 362/103
(58) Field of Search ..... 2/161.6, 167, 160, 2/163; 362/34, 103, 106; 40/586

(56) References Cited

U.S. PATENT DOCUMENTS 1,230,943 A * 6/1917 Sindh ..... 362/103
4,061,910 A * 12/1977 Rosenfeld ..... 362/34
4,234,907 A * 11/1980 Daniel ..... 362/34
4,422,131 A * 12/1983 Clanton et al. ..... 362/186
4,625,339 A 12/1986 Peters
5,323,492 A * 6/1994 DeMars ..... 2/209.13
5,535,105 A * 7/1996 Koenen et al. ..... 362/570
5,580,154 A 12/1996 Coulter et al.
6,006,357 A 12/1999 Mead
6,499,145 B1 * 12/2002 Kates ..... 2/195.1

* cited by examiner

*Primary Examiner*—Katherine Moran

(57) ABSTRACT

A glove apparatus for emitting light in area around the hand of the user. The glove apparatus includes a body member comprising a perimeter wall. The perimeter wall defines an interior space of the body member. The interior space of the body member is designed for selectively receiving the hand of the user. A plurality of light emitting assemblies are positioned in the perimeter wall of the body member. Each of the light emitting assemblies is designed for emitting light to illuminate an area around the hand of the user.

8 Claims, 2 Drawing Sheets

GLOVE APPARATUS

BACKGROUND OF THE INVENTION

1. Field of the Invention

The present invention relates to illuminating gloves and more particularly pertains to a new glove apparatus for emitting light in an area around the hand of the user.

2. Description of the Prior Art

The use of illuminating gloves is known in the prior art. U.S. Pat. No. 4,625,339 describes a system for mounting a flashlight to a glove. Another type of illuminating glove is U.S. Pat. No. 5,580,154 having a light on a glove apparatus to increase the visibility of the user. U.S. Pat. No. 6,006,357 has a plurality of light sources coupled to the glove to allow the glove to emit light.

While these devices fulfill their respective, particular objectives and requirements, the need remains for a device that has certain improved features reducing the bulk of the glove apparatus.

SUMMARY OF THE INVENTION

The present invention meets the needs presented above by providing a plurality of pocket spaces in the perimeter wall of the body member each containing one of the light emitting assemblies.

Still yet another object of the present invention is to provide a new glove apparatus that provides light in proximity to the hand of the user to illuminate objects being worked on by the user.

Even still another object of the present invention is to provide a new glove apparatus that increases the visibility of the user during the night.

To this end, the present invention generally comprises a body member comprising a perimeter wall. The perimeter wall defines an interior space of the body member. The interior space of the body member is designed for selectively receiving the hand of the user. A plurality of light emitting assemblies are positioned in the perimeter wall of the body member. Each of the light emitting assemblies is designed for emitting light to illuminate an area around the hand of the user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
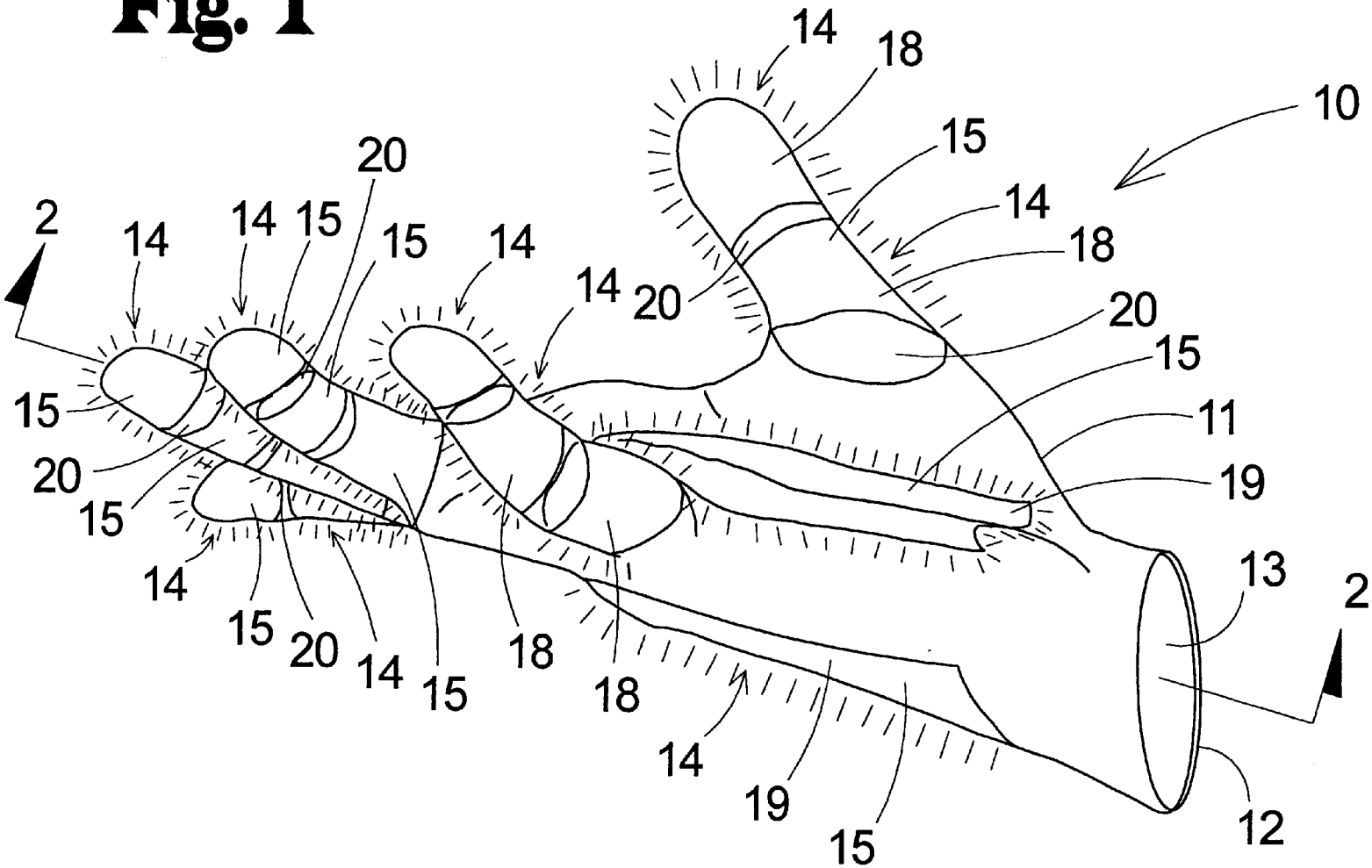
FIG. 1 is a perspective view of a new glove apparatus according to the present invention shown in use.
Figure 2:
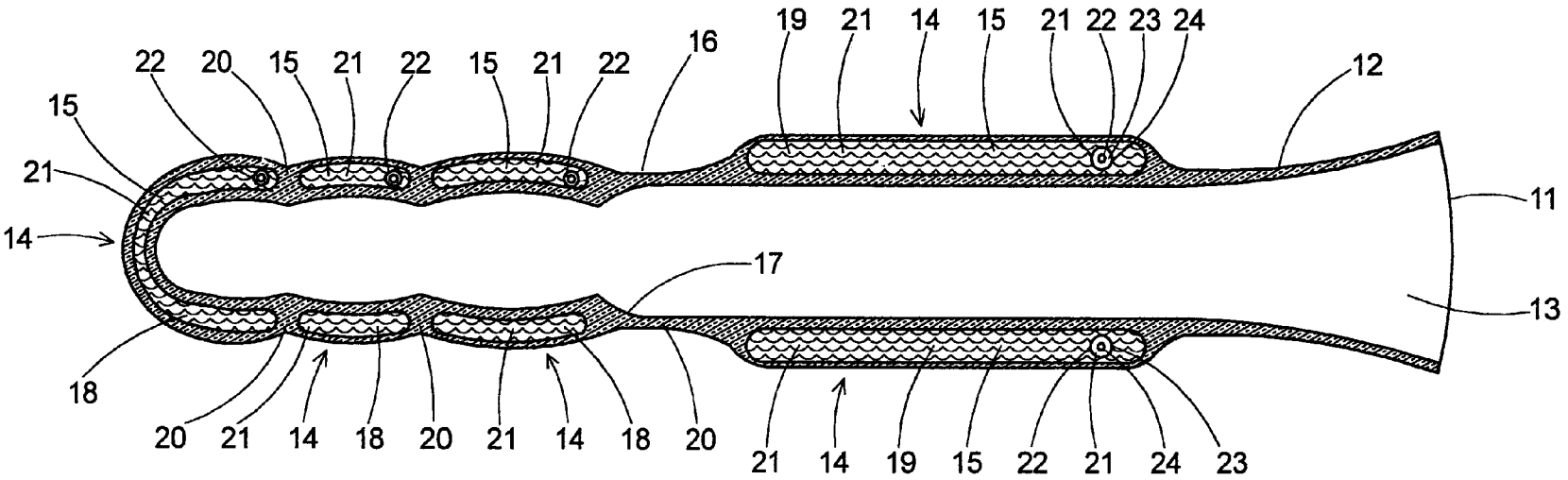
FIG. 2 is an enlarged cross-sectional view of the present invention taken along line 2—2 of FIG. 1.

With reference now to the drawings, and in particular to FIGS. 1 and 2 thereof, a new glove apparatus embodying the principles and concepts of the present invention and generally designated by the reference numeral 10 will be described.

As best illustrated in FIGS. 1 and 2, the glove apparatus 10 generally comprises a body member 11 comprising a perimeter wall 12. The perimeter wall 12 defines an interior space 13 of the body member 11. The interior space 13 of the body member 11 is designed for selectively receiving the hand of the user.

A plurality of light emitting assemblies 14 are positioned in the perimeter wall 12 of the body member 11. Each of the light emitting assemblies 14 is designed for emitting light to illuminate an area around the hand of the user.

The perimeter wall 12 defines a plurality of pocket spaces 15. Each of the pocket spaces 15 is positioned between an exterior surface 16 and an interior surface 17 of the perimeter wall 12. One of the light emitting assemblies 14 is positioned in each of the pocket spaces 15 whereby the pocket spaces 15 are for maintaining positioning of the light emitting assemblies 14.

The plurality of the pocket spaces 15 comprise a plurality of phalange spaces 18. Each of the phalange spaces 18 is designed for being positioned around a phalange of the hand of the user whereby the light emitting assemblies 14 positioned in the phalange spaces 18 emit light in an area adjacent the associated one of the phalanges of the user.

The plurality of pocket spaces 15 comprise a plurality of hand spaces 19. One of the hand spaces 19 is designed for being positioned adjacent a back of the hand of the user. One of the hand spaces 19 is designed for being positioned adjacent a palm of the hand of the user. The light emitting assemblies 14 positioned in said hand spaces 19 are designed for emitting light in an area around the hand of the user.

The perimeter wall 12 of the body member 11 comprises a plurality of joint portions 20. Each of the joint portions 20 is positioned between adjacently positioned pocket spaces 15 whereby each of the joint portions 20 is for isolating one of the pocket spaces 15 from an adjacent one of the pocket spaces 15. Each of the joint portions 20 is designed for being positioned adjacent one of plurality of joints in the hand of the user whereby the joint portions 20 are for permitting the body member 11 contour to the hand of the user when the user is using the hand.

Each of the light emitting assemblies 14 comprises a plurality of chemical compounds 21. The chemical compounds 21 of each of the light emitting assemblies 14 are positioned in one of the pocket spaces 15. The chemical compounds 21 are mixed to form a luminescent compound whereby the luminescent compound is designed for emitting light.

Each of the light emitting assemblies 14 comprises a containment member 22 comprising a peripheral wall 23. The peripheral wall 23 defines a containment space 24. The containment space 24 of the containment member 22 stores one of the chemical compounds 21 whereby the peripheral wall 23 isolates the associated one of the chemical compounds 21 positioned in the containment space 24 of the containment member 22 from the other of the chemical compounds 21 to prevent inadvertent mixing of the chemical compounds 21. The peripheral wall 23 is designed for breaking under pressure from the user to allow the chemical compounds 21 to mix to form the luminescent compound.

The body member 11 comprises a flexible material. The flexible material is designed for contouring to the hand of the user when the hand of the user is positioned in the interior space 13 of the body member 11. The flexible material is transparent whereby the flexible material is designed for permitting light from the light emitting assemblies 14 to pass through the flexible material.

In use, the user crushes the containment member 22 of each of the light emitting assemblies 14. The user then slides the body member 11 over the hand so that the hand is positioned in the interior space 13 of the body of the hand. As the hand of the user is moved around the chemical compounds 21 will mix to form the luminescent compound and emit light.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A glove apparatus for producing light to illuminate an area around the hand of a user, the glove apparatus comprising:

a body member comprising a perimeter wall, said perimeter wall defining an interior space of said body member, said interior space of said body member being adapted for selectively receiving the hand of the user;

a plurality of light emitting assemblies being positioned in said perimeter wall of said body member, each of said light emitting assemblies being adapted for emitting light to illuminate an area around the hand of the user; and said perimeter wall defining a plurality of pocket spaces, each of said pocket spaces being positioned between an exterior surface and an interior surface of said perimeter wall, one of said light emitting assemblies being positioned in each of said pocket spaces such that said pocket spaces are for maintaining positioning of said light emitting assemblies.

2. The glove apparatus as set forth in claim 1, further comprising:

said plurality of said pocket spaces comprising a plurality of phalange spaces, each of said phalange spaces being adapted for being positioned around a phalange of the hand of the user such that said light emitting assemblies positioned in said phalange spaces emit light in an area adjacent the associated one of the phalanges of the user.

3. The glove apparatus as set forth in claim 1, further comprising:

said plurality of pocket spaces comprising a plurality of hand spaces, one of said hand spaces being adapted for being positioned adjacent a back of the hand of the user, one of said hand spaces being adapted for being positioned adjacent a palm of the hand of the user, said light emitting assemblies positioned in said hand space being adapted for emitting light in an area around the hand of the user.

4. The glove apparatus as set forth in claim 1, further comprising:

said perimeter wall of said body member comprising a plurality of joint portions, each of said joint portions being positioned between adjacently positioned pocket spaces such that each of said joint portions is for isolating one of said pocket spaces from an adjacent one of said pocket spaces, each of said joint portions is adapted for being positioned adjacent one of plurality of joints in the hand of the user such that said joint portions are for permitting said body member contour to the hand of the user when the user is using the hand.

5. The glove apparatus as set forth in claim 1, further comprising:

each of said light emitting assemblies comprising a plurality of chemical compounds, said chemical compounds of each of said light emitting assemblies being positioned in one of said pocket spaces, said chemical compounds being mixed to form a luminescent compound such that said luminescent compound is adapted for emitting light.

6. The glove apparatus as set forth in claim 5, further comprising:

each of said light emitting assemblies comprising a containment member comprising a peripheral wall, said peripheral wall defining a containment space, said containment space of said containment member storing one of said chemical compounds such that said peripheral wall isolates the associated one of said chemical compounds positioned in said containment space of said containment member from the other of said chemical compounds to prevent inadvertent mixing of said chemical compounds, said peripheral wall being adapted for breaking under pressure from the user to allow said chemical compounds to mix to form said luminescent compound.

7. The glove apparatus as set forth in claim 1, further comprising:

said body member comprising a flexible material, said flexible material being adapted for contouring to the hand of the user when the hand of the user is positioned in said interior space of said body member, said flexible material being transparent such that said flexible material is adapted for permitting light from said light emitting assemblies to pass through said flexible material.

8. A glove apparatus for producing light to illuminate an area around the hand of a user, the glove apparatus comprising:

a body member comprising a perimeter wall, said perimeter wall defining an interior space of said body member, said interior space of said body member being adapted for selectively receiving the hand of the user;

a plurality of light emitting assemblies being positioned in said perimeter wall of said body member, each of said light emitting assemblies being adapted for emitting light to illuminate an area around the hand of the user;

said perimeter wall defining a plurality of pocket spaces, each of said pocket spaces being positioned between an exterior surface and an interior surface of said perimeter wall, one of said light emitting assemblies being positioned in each of said pocket spaces such that said pocket spaces are for maintaining positioning of said light emitting assemblies;

said plurality of said pocket spaces comprising a plurality of phalange spaces, each of said phalange spaces being adapted for being positioned around a phalange of the hand of the user such that said light emitting assemblies positioned in said phalange spaces emit light in an area adjacent the associated one of the phalanges of the user;

said plurality of pocket spaces comprising a plurality of hand spaces, one of said hand spaces being adapted for being positioned adjacent a back of the hand of the user, one of said hand spaces being adapted for being positioned adjacent a palm of the hand of the user, said light emitting assemblies being adapted for emitting light in an area around the hand of the user;

said perimeter wall of said body member comprising a plurality of joint portions, each of said joint portions being positioned between adjacently positioned pocket spaces such that each of said joint portions is for isolating one of said pocket spaces from an adjacent one of said pocket spaces, each of said joint portions is adapted for being positioned adjacent one of plurality of joints in the hand of the user such that said joint portions are for permitting said body member contour to the hand of the user when the user is using the hand;

each of said light emitting assemblies comprising a plurality of chemical compounds, said chemical compounds of each of said light emitting assemblies being positioned in one of said pocket spaces, said chemical compounds being mixed to form a luminescent compound such that said luminescent compound is adapted for emitting light;

each of said light emitting assemblies comprising a containment member comprising a peripheral wall, said peripheral wall defining a containment space, said containment space of said containment member storing one of said chemical compounds such that said peripheral wall isolates the associated one of said chemical compounds positioned in said containment space of said containment member from the other of said chemical compounds to prevent inadvertent mixing of said chemical compounds, said peripheral wall being adapted for breaking under pressure from the user to allow said chemical compounds to mix to form said luminescent compound; and said body member comprising a flexible material, said flexible material being adapted for contouring to the hand of the user when the hand of the user is positioned in said interior space of said body member, said flexible material being transparent such that said flexible material is adapted for permitting light from said light emitting assemblies to pass through said flexible material.

* * * * *